US005169298A

United States Patent [19]

Hekman et al.

[11] Patent Number: 5,169,298

[45] Date of Patent: Dec. 8, 1992

[54] CONSTRAINED VANE COMPRESSOR WITH OIL SKIVE

[75] Inventors: Edward W. Hekman, Alto; Frederick A. Hekman, Grand Rapids, both of Mich.

[73] Assignee: Autocam Corporation, Kentwood, Mich.

[21] Appl. No.: 756,178

[22] Filed: Sep. 6, 1991

[51] Int. Cl.[5] ..... F04C 18/344; F04C 29/02

[52] U.S. Cl. ..... 418/1; 418/100; 418/265; 418/DIG. 1

[58] Field of Search ..... 418/1, 46, 95, 97-100, 418/189, 260-265, DIG. 1

[56] References Cited

U.S. PATENT DOCUMENTS

| | | | |
|---|---|---|---|
| 1,002,023 | 8/1911 | Beach et al. | 418/189 |
| 3,001,482 | 9/1961 | Osborn | 418/264 |
| 3,890,071 | 6/1975 | O'Brien | 418/260 |
| 3,956,904 | 5/1976 | Edwards | 418/225 |
| 4,088,426 | 5/1978 | Edwards | 418/8 |
| 4,299,097 | 11/1981 | Shank et al. | 418/150 |
| 4,410,305 | 10/1983 | Shank et al. | 418/150 |
| 4,789,317 | 12/1988 | Waser et al. | 418/189 |

FOREIGN PATENT DOCUMENTS

| | | | |
|---|---|---|---|
| 59-96496 | 6/1984 | Japan | 418/97 |

*Primary Examiner*—John J. Vrablik

*Attorney, Agent, or Firm*—Price, Heneveld, Cooper, DeWitt & Litton

[57] ABSTRACT

A constrained rotary vane compressor having a rotor-vane assembly within a stator often exhibits unwanted noise and vibration effects. The present invention offers a design and method to decrease noise and vibration effects of such compressors by the incorporation of an oil skive formed in the interior wall of the stator. The oil skive rids the vane tips of any excess liquid which may have collected on the rotating vanes, which otherwise may impact certain interior regions of the stator resulting in unwanted noise and vibration of the compressor.

26 Claims, 6 Drawing Sheets

CONSTRAINED VANE COMPRESSOR WITH OIL SKIVE

BACKGROUND OF THE INVENTION

Constrained rotary vane compressors are known which utilize a rotor and an assembly of vanes rotating within a fixed, cylindrical stator housing. Such devices operate by the rotor having an axis of rotation offset from the axial centerline of the stator housing. Thus, compartments of varying volume are formed, defined by the regions between adjacent vanes, the stator interior, and the end walls of the stator.

Constrained rotary vane compressors differ from rotary vane compressors in that they include means for constraining the vanes from directly contacting the interior circumferential wall of the stator housing. Typically this is done by means of annular tracks formed in the stator end walls. The vanes include guide rollers projecting from either side and engaging said tracks.

The rollers and tracks constrain the vanes such that the distal edges of the vanes come in very close proximity to the interior wall of the stator housing, without actually contacting the wall, at particular points or regions to prevent the escape of fluid (i.e. gas or vapor) as the vanes rotate thereby performing the compression operation. There is a tendency for these vanes to vibrate and generate noise as they rotate, a characteristic rarely seen in unconstrained rotary vane compressors. In addition to the objectionable noise, the vibration increases wear and tear on the device. While many solutions to the noise/vibration problem in such devices have been employed with varying degrees of success, prior artisans have not heretofore satisfactorily solved the problem nor even appreciated at least one of the sources of the problem.

SUMMARY OF THE INVENTION

In the present invention, it has been discovered that noise and vibration problems arise in constrained rotary vane compressors when even slight amounts of liquid collect on the distal vane tips. Such liquid is typically lubricating oil that is intentionally circulated through the refrigeration system with the refrigerant. Additionally, under certain conditions slugs of refrigerant may enter the compressor still in their liquid state. Any such liquid that collects on the vane surface will tend to migrate to the distal vane tip by centrifugal action. As the vanes rotate throughout the interior of the stator past the inlet opening and into the compression region, liquid collected on the vanes apparently becomes trapped between a distal vane tip and the interior surface of the stator. In light of the high velocity of the vane relative to the stator, the fluid cannot flow fast enough to vacate the essentially instantaneous decrease in clearance between the vane tip and the interior surface of the stator, in the vicinity of the intake. Therefore, the liquid impacts the interior surface of the stator which imparts a force upon the vane assembly. This force then induces vibration of the compressor components and generates significant noise.

The present invention solves this problem through use of an oil skive comprising a depression formed in and across the width of the interior circumferential wall of the stator. The depression is located on the stator's interior between the inlet port of the compressor and the beginning of the compression region. The trailing wall of the depression, that is the wall of the depression which the rotating vanes pass last as they rotate, cuts across the interior wall of the stator at an angle to the axial centerline of the stator to provide a skiving action across the tip of a vane as it passes the trailing wall.

These and other objects, advantages and features of the invention can be more fully understood and appreciated by reference to the written specification and appended drawings.

DESCRIPTION OF THE PREFERRED EMBODIMENT

Figure 1:
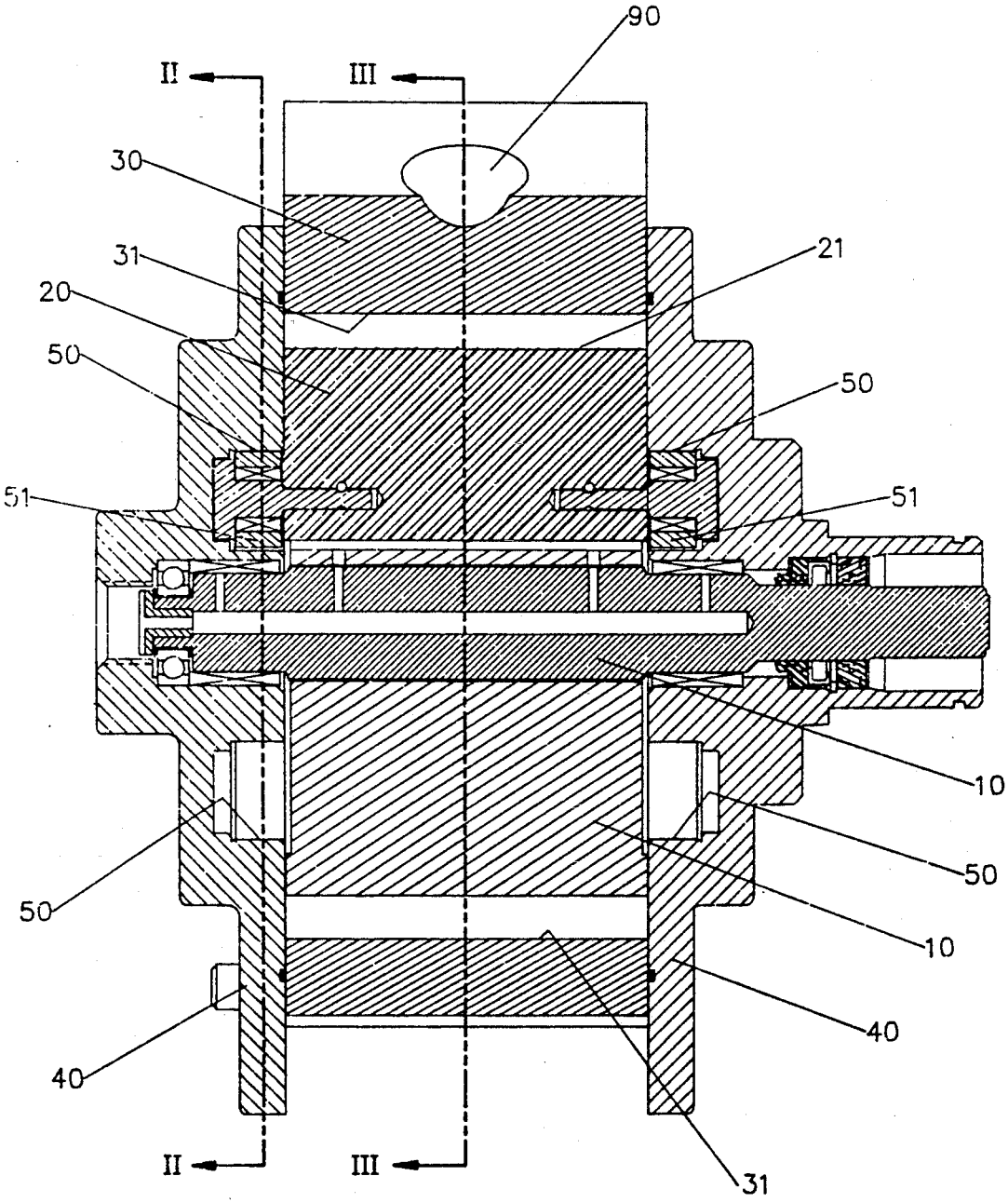
FIG. 1 is a cross section of a typical constrained rotary vane compressor taken along planes I—I of FIG. 3.
Figure 2:
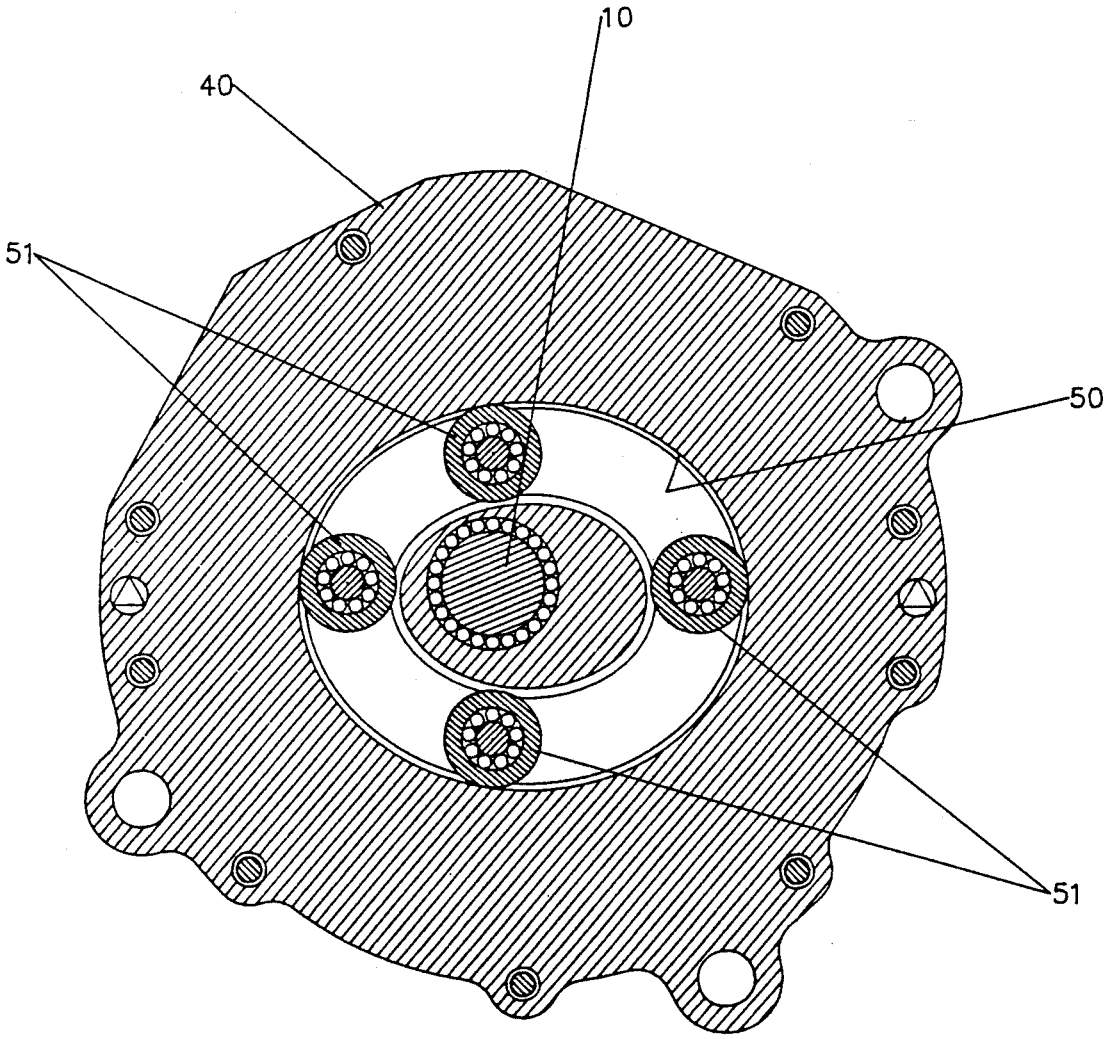
FIG. 2 is a sectional view of a typical constrained rotary vane compressor taken along plane II—II of FIG. 1, showing the rollers and constraining annular track in the stator end cap.

In the preferred embodiment, a constrained rotary vane-type compressor (FIGS. 1, 2 and 3), has a central rotor 10 having a plurality of vanes 20 slideably extending radially outward from rotor 10, residing within a stator 30. Stator 30 has end caps 40 formed or attached at both ends. The axis of rotation 11 of rotor 10 is offset from, but parallel to, the axial centerline 32 of stator 30 so as to form vaned compartments of varying volume throughout the cycle of rotation. The distal vane tips 21 of vane 20 "engage" the interior surface 31 of stator 30, thereby forming a proper seal between vane compartments throughout the region of compression. Otherwise, fluid in a particular compartment undergoing compression may escape to other regions within the stator, thereby lowering the overall efficiency of the compressor. By "engage" it is meant that the distal vane tips come into very near proximity to the surface of the stator interior In normal operation the interior surface 31 of the stator will become coated with lubricating oil which will act to seal this gap. In the preferred embodiment, the gap between the vane tip and the interior surface of the stator is in the range of 0.025 to 0.127 mm, (0.001 to 0.005 inches). To assist such engagement, the vanes may be further guided by tracks 50 in end caps 40 of stator 30. Thus, each vane 20 is equipped with at least one roller 51 which runs in tracks 50. Track 50 provides a cam surface for roller 51 contacting it, such that as the rollers progress about a track, vanes 20 are guided as they rotate within the interior of stator 30.

Figure 3:
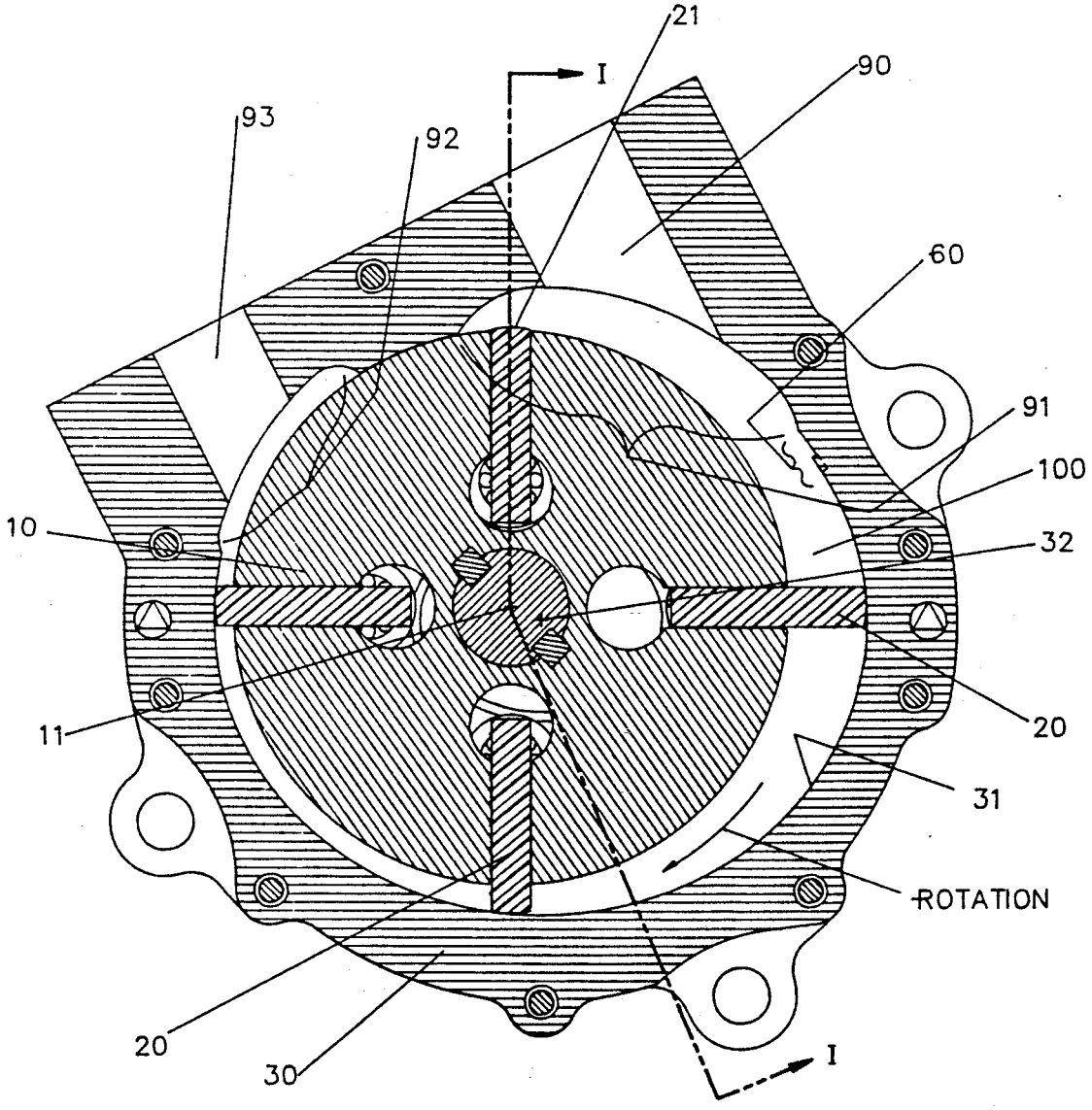
FIG. 3 is a sectional view of a typical constrained rotary vane compressor utilizing an oil skive of the present invention, taken along plane III—III of FIG. 1.
Figure 4:
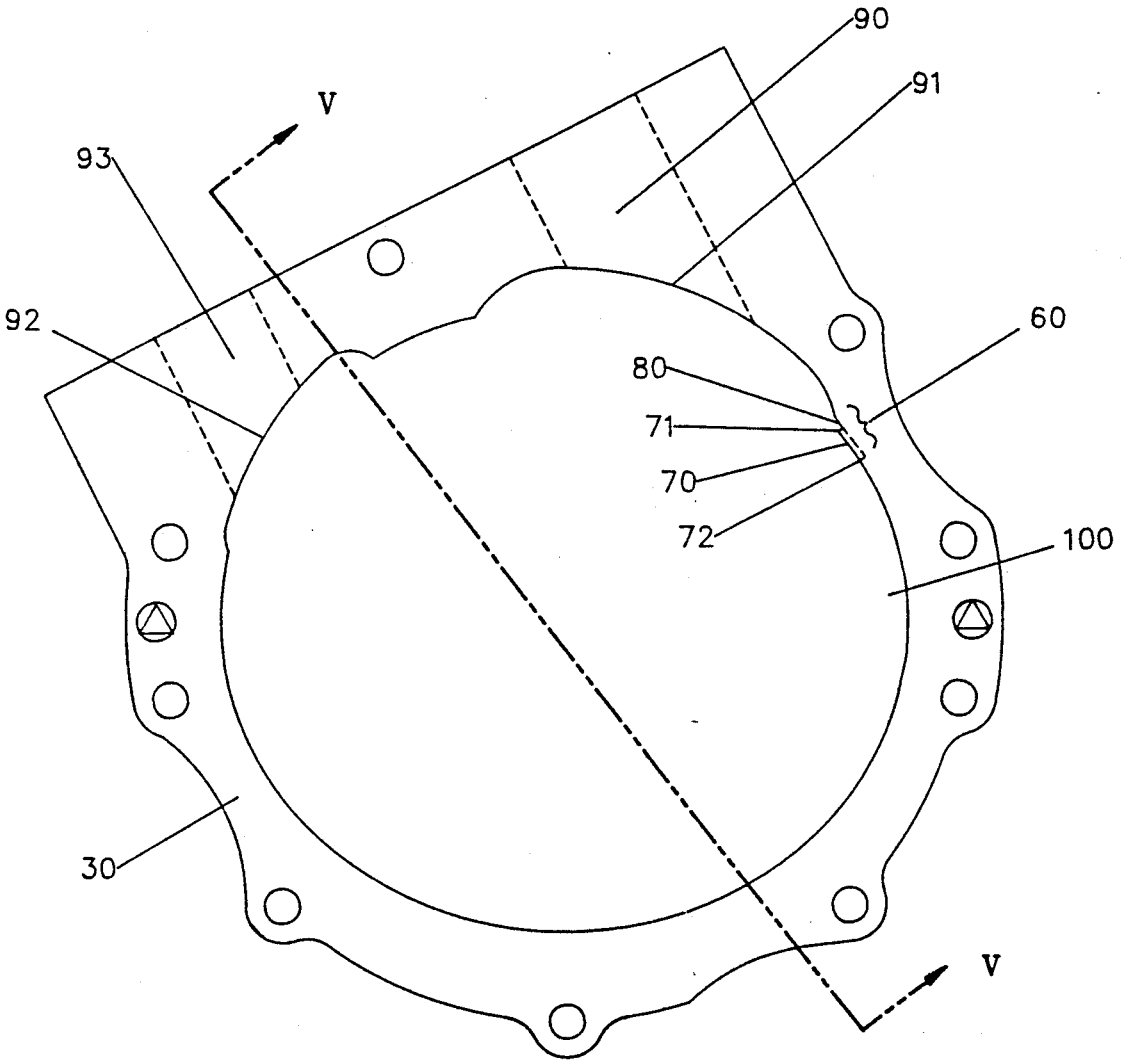
FIG. 4 is a side view of a typical stator housing to more clearly show the oil skive of the present invention.

Since the vane tip 21 does not actually touch the interior surface 31 of the stator 30 and the vane 20 does not rely on the interior surface 31 to arrest its centrifugal acceleration, it is possible to relieve certain portions of the stator interior substantially from the circumferential profile which the vane tip traces. (This is not possible with a conventional, unconstrained, rotary vane compressor.) Creating such relieved areas is, in fact, quite desirable in the vicinity of the inlet 90 and outlet 93 inasmuch as it allows a more gradual transition of the fluid flow and reduces energy losses in these areas. In FIGS. 3 and 4 it can be seen that the inlet port surface 91 and outlet port surface 92 are both relieved in this manner.

Throughout the operation of most conventional constrained rotary vane compressors, various liquids may collect on the exposed surfaces of the vanes. Indeed, as previously noted, lubricating oil is purposely circulated with the refrigerant to aid in sealing and as a lubricant. In addition, under certain conditions slugs of refrigerant still in their liquid state may be encountered. As the vanes rapidly rotate, centrifugal force directs the liquids collected on the vane surfaces to the distal ends of the vanes. When the vane tip clearance is increased, as in the region near inlet port surface 91, a ridge of liquid may form on the tip of the vane. This ridge of liquid may have a height such that when situated on the end of a rotating vane, the effective radial dimension of the vane exceeds the radial dimension of the stator interior. Thus, upon a vane entering the region of compression, the liquid may become trapped between the interior surface of the stator and the distal vane tip. The essentially instantaneous decrease in clearance above the tip of the vane does not allow sufficient time for the relatively viscous liquid to be displaced from the vane tip. The result is that liquid then impacts the interior surface of the stator which imparts a force upon the vane assembly. Occurrence of this is often exhibited as noise and vibration of the compressor.

Figure 5:
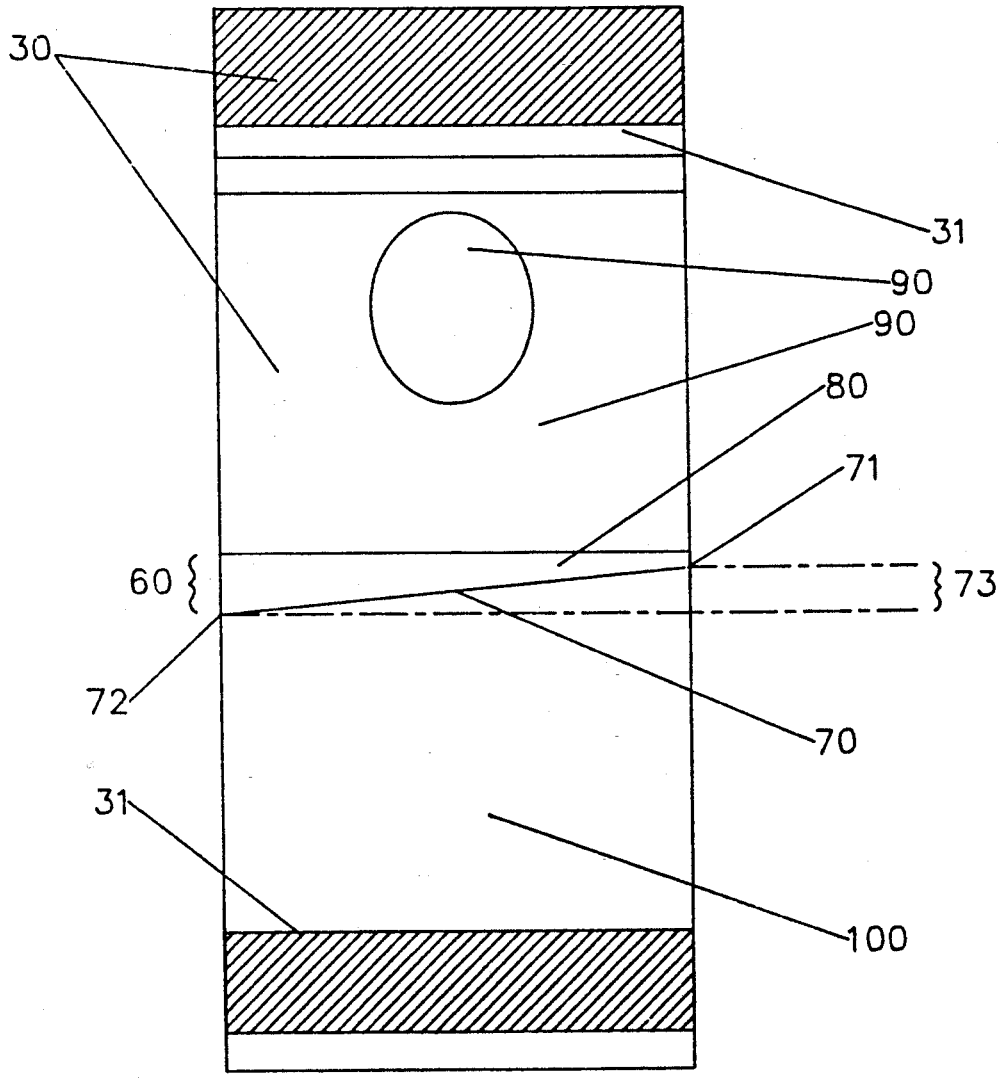
FIG. 5 is a cross section of the stator housing taken along plane V—V of FIG. 4, which allows fuller appreciation of the details of the oil skive.

FIGS. 4 and 5 clearly show the preferred embodiment of the oil skive 60 of the present invention. Oil skive 60 is essentially an angular depression in the generally cylindrical stator wall 31 comprising a depression bottom wall 80 and a trailing wall or step 70 formed in the interior wall 31 of stator 30. Step 70 is referred to as the trailing wall of oil skive 60 because it is the last wall of oil skive 60 which vanes 20 pass as they rotate. The formation, (typically by machining) results in depression bottom wall 80 formed on one side of trailing wall 70. Skive 60 (trailing wall 70 and accompanying depression bottom wall 80) is located between inlet port 90 of the compressor and region 100 where compression begins. The oil skive must be machined at the intersection point of inlet port surface 91 and stator interior 31 such that the oil skive 60 is the first point of engagement for a vane entering compression region 100 of stator 30.

The height of trailing wall 70 is preferably between about 0.5 mm to about 2.0 mm; such height is more or less constant as the trailing wall extends across the width of the interior wall of stator 30. Oil skive 60 (trailing wall 70 and depression bottom wall 80) preferably extends substantially across the width of stator 30, and most preferably entirely so as this maximizes the benefits and advantages of the present invention. It is crucial to the function of the oil skive 60 that the intersection of trailing wall 70 and stator interior 31 be essentially a sharp edge.

FIG. 5 shows clearly that the trailing wall 70 extends across the width of stator 30 at a slight angle to the axial centerline of stator 30 projected onto stator wall 31. In the preferred embodiment, trailing wall 70 is oriented such that as the vane 20 approaches the oil skive 60, the liquid-covered distal tip of the vane will make contact first at point 71. As the vane movement progresses the point of contact (where oil is being skived off the vane tip) will shift from 71 to the opposite end 72 of the trailing wall 70. The projected length 73 of skive trailing wall 70 is equal to the distance that the vane travels during this skiving action and, with the rpm, determines the amount of time during which the oil can be displaced from the vane tip. If distance 73 is zero, there is essentially no time for oil displacement and large hydraulic forces, vibration, etc. ensue. In the preferred embodiment distance 73 is approximately the same as the thickness of one vane 20 used in the compressor, resulting in an angular orientation of trailing wall 70 to the axial centerline of stator 30 of approximately 10°. In the broader aspects of the invention, this angle can be from about 1° to 30°.

Liquid which has been wiped off a passing vane 20 collects on trailing wall 70 and on depression bottom wall 80 existing on one side of trailing wall 70. The surface of depression bottom wall 80 extends from trailing wall 70 to its intersection with inlet port surface 91. As trailing wall 70 is oriented at some angle to the vane 20 edge, the liquid collected on depression bottom wall 80 is further directed towards that end of trailing wall 70 which last engages a passing vane 20. This collected liquid is then swept into the general compression region after the vane 20 has passed the trailing wall 70, and before the next vane 20 approaches.

The trailing wall 70, as seen in FIG. 4, should be oriented approximately perpendicular to the path of the tip of passing vane 20, or even undercut, to ensure that the skiving action will not generate a radial force onto the vane 20. As shown in FIGS. 3–4, the trailing wall 70 is generally radially oriented with respect to stator 30, substantially in the same plane as a vane 20 having reached its point of closest approach to wall 70 while sweeping past oil skive 60. Furthermore, the surface of depression bottom wall 80 intersects trailing wall 70 face surface at an angle of 90° in the preferred embodiment. However, it is envisioned that a range of trailing wall face angles may be utilized, greater or lesser than 90°.

Figure 6:
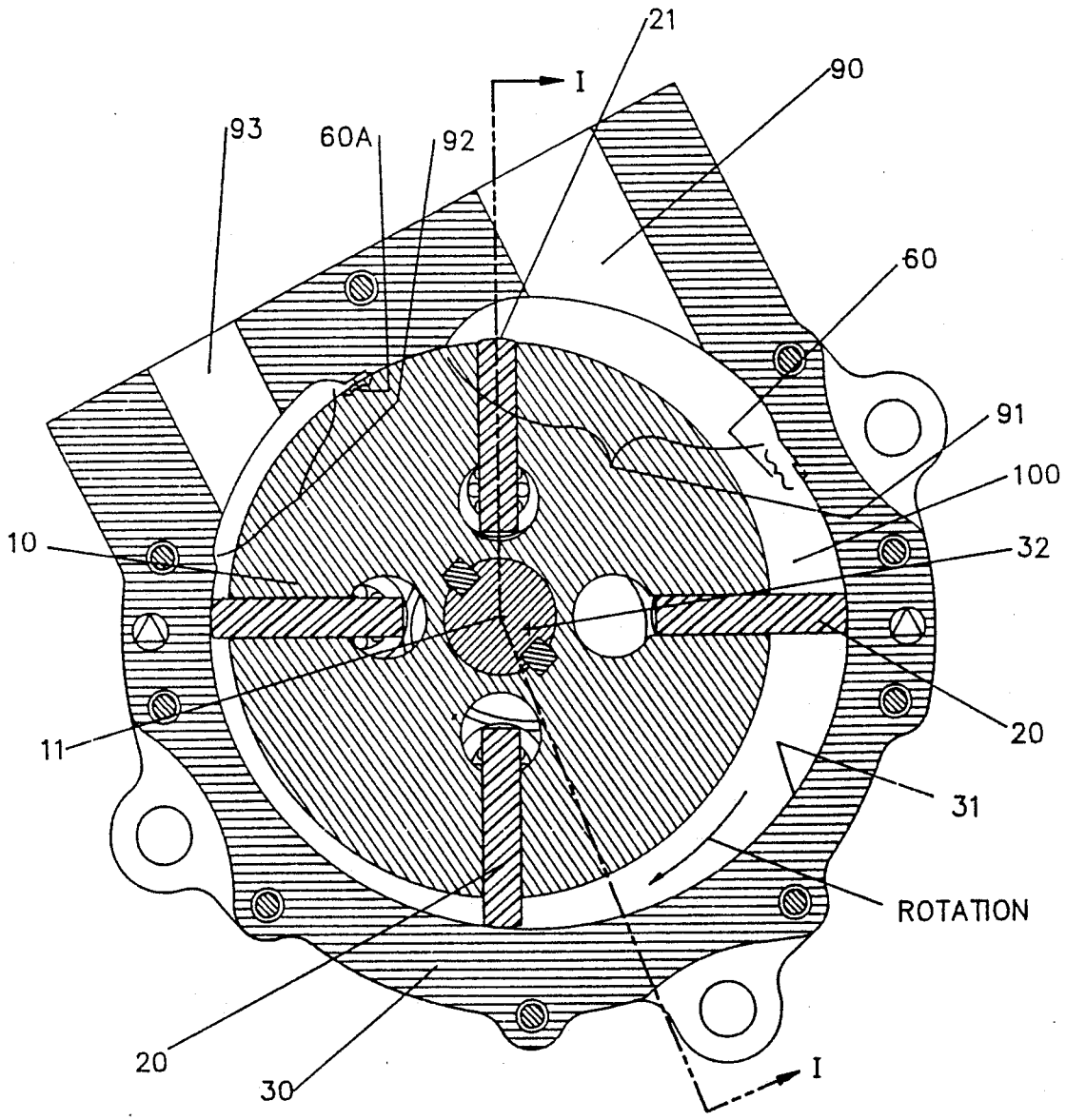
FIG. 6 is a sectional view of a typical constrained rotary vane compressor utilizing a plurality of oil skives of the present invention, taken along plane III—III of FIG. 1.

In the foregoing, skive 60 has been shown positioned just "downstream" (in the direction of rotation of rotor 10 and vanes 20) from inlet port 90. In the broader aspects of the invention, the skive, or multiple skives, could be located at different points throughout the stator. A logical location for such a skive is any point at which vane tips 21 move from an area where they are not in close proximity to the interior surface 31 of stator 30 to a point where they re-approach close proximity to the interior surface 31. Thus a logical location for a second oil skive 60A in the preferred embodiment shown would be just on the downstream side of the exhaust port 93 as illustrated in FIG. 6.

Of course, it is understood that the foregoing is merely a preferred embodiment of the invention and that various changes and alterations can be made without departing from the spirit and broader aspects thereof as set forth in the appended claims, which are to be interpreted in accordance with the principles of patent law, including the doctrine of equivalents.

The embodiments of the invention in which an exclusive property or privilege is claimed are defined as follows:

1. A constrained rotary vane compressor having:

a stator, said stator having a hollow interior and a circumferential interior wall;

a gas inlet port and a gas outlet port into said stator interior through said circumferential interior wall, a lubricating oil entrained in and circulating with said gas through said compressor;

a rotor, said rotor mounted in said stator such that the axis of rotation of said rotor is parallel to but offset from the axial centerline of said stator;

a plurality of vanes, said vanes slideably positioned in and extending radially from said rotor;

the geometric relationship between said inlet and output ports, said stator circumferential interior wall, said vanes and said rotor being such that the volume between adjacent vanes progressively diminishes as said vanes rotate from said inlet towards said outlet, to thereby compress gas passing through said compressor;

means for constraining said vanes in their outward movement relative to said rotor such that the distal edges of said vanes travel in close proximity to said circumferential interior wall of said stator; and an oil skive for displacing oil from said distal edges of said vanes comprising a depression extending across the width of said stator interior wall, said depression including a trailing wall which extends across the width of said circumferential interior wall of said stator from a first end to a second end, at an angle to said axial centerline of said stator.

2. A constrained rotary vane compressor in accordance with claim 1, wherein said oil skive is located on said interior wall of said stator between said inlet port and a region where compression begins.

3. A constrained rotary vane compressor in accordance with claim 2, wherein said trailing wall of said oil skive is oriented between 1° and 30° to either side of said axial centerline of said stator.

4. A constrained rotary vane compressor in accordance with claim 3, wherein said trailing wall extends a radial distance of between about 0.5 mm to about 2.0 mm into said interior wall of said stator.

5. A constrained rotary vane compressor in accordance with claim 4, wherein said trailing wall is oriented generally radially in said stator interior.

6. A constrained rotary vane compressor in accordance with claim 5, wherein said depression bottom wall intersects said interior wall of said stator at said inlet port surface.

7. A constrained rotary vane compressor in accordance with claim 6, wherein said trailing wall is oriented at an angle to said axial centerline of said stator such that the projected distance along said circumferential interior wall between said first end of said trailing wall and said second end of said trailing wall is substantially the same as the thickness of said vane.

8. A constrained rotary vane compressor in accordance with claim 1, wherein said trailing wall of said oil skive is oriented between 1 and 30 to either side of said axial centerline of said stator.

9. A constrained rotary vane compressor in accordance with claim 8, wherein said trailing wall extends a radial distance of between about 0.5 mm to about 2.0 m into said interior wall of said stator.

10. A constrained rotary vane compressor in accordance with claim 1, wherein said trailing wall is oriented at an angle to said axial centerline of said stator such that the projected distance along said circumferential interior wall between said first end of said trailing wall and said second end of said trailing wall is substantially the same as the thickness of said vane.

11. A constrained rotary vane compressor in accordance with claim 10, wherein said trailing wall extends a radial distance of between about 0.5 mm to about 2.0 mm into said interior wall of said stator.

12. A constrained rotary vane compressor in accordance with claim 1, wherein said trailing wall extends a radial distance of between about 0.5 mm to about 2.0 mm.

13. A constrained rotary vane compressor in accordance with claim 1, wherein two or more skives are employed on the interior of said stator.

14. A method of decreasing and noise effects in a constrained rotary vane compressor having:

a statory having a hollow interior and a circumferential interior wall;

a gas inlet port and a gas outlet port into said stator interior wall through said circumferential interior wall, a lubricating oil entrained in and circulating with said gas through said compressor;

a rotor, said rotor mounted in said stator such that the axis of rotation of said rotor is parallel to but offset from the axial centerline of said stator;

a plurality of vanes, said vanes slideably positioned in and extending radially from said rotor; and the geometric relationship between said inlet and outlet ports, said stator circumferential interior wall, said vanes and said rotor being such that the volume between adjacent vanes progressively diminishes as said vanes rotate from said inlet towards said outlet, to thereby compress gas passing through said compressor;

means for constraining said vanes in their outward movement relative to said rotor such that the distal edges of said vanes travel in close proximity to said circumferential interior wall of said stator;

wherein said method comprises forming an oil skive for displacing oil from said distal edges of said vanes comprising a depression extending across the width of said stator interior wall, said depression including a trailing wall which extends across the width of said circumferential interior wall of said stator from a first end to a second end, at an angle to said axial centerline of said stator.

15. A method of decreasing vibration and noise effects in a constrained rotary vane compressor in accordance with claim 14, wherein said method further comprises:

forming said oil skive on said interior wall of said stator between said inlet port and a region where compression begins.

16. A method of decreasing vibration and noise effects in a constrained rotary vane compressor in accordance with claim 15, wherein said method further comprises:

forming said oil skive such that said trailing wall is oriented between 1° and 30° to either side of said axial centerline of said stator.

17. A method of decreasing vibration and noise effects in a constrained rotary vane compressor in accordance with claim 16, wherein said formation of said oil skive further comprises:

forming said trailing wall such that said trailing wall extends a radial distance of between about 0.5 mm to about 2.0 mm into said interior wall of said stator.

18. A method of decreasing vibration and noise effects in a constrained rotary vane compressor in accordance with claim 17, wherein said formation of said oil skive further comprises:

orienting said trailing wall generally radially in said stator interior.

19. A method of decreasing vibration and noise effects in a constrained rotary vane compressor in accordance with claim 18, wherein said formation of said oil skive further comprises:

forming said depression bottom wall such that said depression bottom wall intersects said interior wall of said stator at said inlet port surface.

20. A method of decreasing vibration and noise effects in a constrained rotary vane compressor in accordance with claim 19, wherein said formation of said oil skive further comprises:

orienting said trailing wall at an angle to said axial centerline of said stator such that the projected distance along said circumferential interior wall between said first end of said trailing wall and said second end of said trailing wall is substantially the same as the thickness of said vane.

21. A method of decreasing vibration and noise effects in a constrained rotary vane compressor in accordance with claim 14, wherein said method further comprises:

forming said oil skive such that said trailing wall is oriented between 1° and 30° to either side of said axial centerline of said stator.

22. A method of decreasing vibration and noise effects in a constrained rotary vane compressor in accordance with claim 21 wherein said formation of said oil skive further comprises:

forming said trailing wall such that said trailing wall extends a radial distance of between about 0.5 mm to about 2.0 mm into said interior wall of said stator.

23. A method of decreasing vibration and noise effects in a constrained rotary vane compressor in accordance with claim 14, wherein said formation of said oil skive further comprises:

orientating said trailing wall at an angle to said axial centerline of said stator such that the projected distance along said circumferential interior wall between said first end of said trailing wall and said second end of said trailing wall is substantially the same as the thickness of said vane.

24. A method of decreasing vibration and noise effects in a constrained rotary vane compressor in accordance with claim 23, wherein said formation of said oil skive further comprises:

forming said trailing wall such that said trailing wall extends a radial distance of between about 0.5 mm to about 2.0 mm into said interior wall of said stator.

25. A method of decreasing vibration and noise effects in a constrained rotary vane compressor in accordance with claim 14, wherein said formation of said oil skive further comprises:

forming said trailing wall such that said trailing wall extends a radial distance of between about 0.5 mm to about 2.0 mm into said interior wall of said stator.

26. A method of decreasing vibration and noise effects in a constrained rotary vane compressor in accordance with claim 14, wherein said method further comprises: forming two or more skives on the interior of said stator.

* * * * *

UNITED STATES PATENT AND TRADEMARK OFFICE

CERTIFICATE OF CORRECTION

PATENT NO. : 5,169,298

DATED : December 8, 1992

INVENTOR(S) : Edward W. Hekman et al.

It is certified that error appears in the above-identified patent and that said Letters Patent is hereby corrected as shown below:

Column 2, line 51:
After "interior" insert --.--.

Column 5, claim 1, line 11:
"output" should be --outlet--.

Column 5, claim 8, line 56:
"1 and 30" should be --1° and 30°--.

Column 5, claim 9, line 60:
"2.0m" should be --2.0mm--.

Column 6, claim 14, line 12:
After "decreasing" insert --vibration--.

Signed and Sealed this

Twenty-second Day of February, 1994

*Attest:*

Bruce Lehman

BRUCE LEHMAN

*Attesting Officer*

*Commissioner of Patents and Trademarks*